US007972227B2

(12) United States Patent
Lamson

(10) Patent No.: US 7,972,227 B2
(45) Date of Patent: Jul. 5, 2011

(54) LACROSSE HANDLE WITH GRIPPING STRUCTURE

(75) Inventor: Kyle L. Lamson, Chelmsford, MA (US)

(73) Assignee: Warrior Sports, Inc., Warren, MI (US)

( * ) Notice: Subject to any disclaimer, the term of this patent is extended or adjusted under 35 U.S.C. 154(b) by 231 days.

(21) Appl. No.: 12/470,644

(22) Filed: May 22, 2009

(65) Prior Publication Data

US 2009/0291783 A1 Nov. 26, 2009

Related U.S. Application Data

(60) Provisional application No. 61/055,488, filed on May 23, 2008.

(51) Int. Cl.
*A63B 59/02* (2006.01)
*A63B 65/12* (2006.01)

(52) U.S. Cl. ..... 473/513; D21/724

(58) Field of Classification Search ..... 473/505, 473/512, 513; D21/724, 756; D8/303; 16/420–422; 451/490

See application file for complete search history.

(56) References Cited

U.S. PATENT DOCUMENTS

| | | | |
|---|---|---|---|
| D5,178 | S | 8/1871 | Gould |
| 185,374 | A | 12/1876 | Whitehouse |
| 328,905 | A | 10/1885 | Strasser et al. |
| D22,250 | S | 2/1893 | Harsha |
| D22,271 | S | 3/1893 | Ruxton |
| 1,810,885 | A | 6/1931 | Neuberth |
| 1,839,919 | A | 1/1932 | Hall |
| 1,928,009 | A | 9/1933 | Dornier |
| 1,963,057 | A | 6/1934 | Wilcox |
| 2,237,969 | A | 4/1941 | Olsen |
| 3,697,069 | A | 10/1972 | Merola |
| 3,702,702 | A | 11/1972 | Hoult |
| 3,840,230 | A | 10/1974 | Schaefer et al. |
| 3,972,529 | A | 8/1976 | McNeil |
| 4,037,841 | A | 7/1977 | Lewis, Jr. |
| D245,756 | S | 9/1977 | McKee |
| 4,206,918 | A | 6/1980 | Lewis, Jr. |
| 4,233,834 | A | 11/1980 | Matinlassi |
| 4,280,727 | A | 7/1981 | Germain |
| 4,445,354 | A | 5/1984 | Pfeiffer et al. |
| 4,739,994 | A | 4/1988 | Lewis, Jr. |
| 5,048,843 | A | 9/1991 | Dorfi et al. |

(Continued)

OTHER PUBLICATIONS

T122, Lacrosse Handle—Brine (prior art).

(Continued)

*Primary Examiner* — Gene Kim
*Assistant Examiner* — M Chambers
(74) *Attorney, Agent, or Firm* — Warner Norcross & Judd LLP

(57) ABSTRACT

A lacrosse handle including a gripping structure that provides a user with an improved grip of the handle. The gripping structure can provide tactile feedback regarding the precise positioning of the lower hand at a particular location between the top end and bottom end of the handle. Optionally, the upper portion of the lacrosse handle may remain substantially bare, allowing a user to easily position and reposition their upper hand by sliding the hand up and down the upper portion of the handle during play. The gripping structure can be formed having one or more layers of a clear lacquer material and one or more ink layers applied to the outer surface of the handle via a wet transfer technique, or other processes.

23 Claims, 3 Drawing Sheets

U.S. PATENT DOCUMENTS

| | | | | |
|---|---|---|---|---|
| 5,261,665 | A * | 11/1993 | Downey | 473/303 |
| 5,348,360 | A * | 9/1994 | Mencarelli et al. | 294/57 |
| 5,651,744 | A | 7/1997 | Millon et al. | |
| 5,749,798 | A | 5/1998 | Kuebler et al. | |
| 5,823,069 | A * | 10/1998 | Roark et al. | 74/551.9 |
| 5,951,078 | A | 9/1999 | Whitehead et al. | |
| 6,105,460 | A * | 8/2000 | Li | 74/551.9 |
| 6,235,134 | B1 | 5/2001 | Mueller | |
| 6,500,079 | B1 | 12/2002 | Tucker, Sr. | |
| 6,723,134 | B2 | 4/2004 | Tucker, Sr. | |
| 6,752,730 | B1 | 6/2004 | Brine, Jr. et al. | |
| 6,889,405 | B2 * | 5/2005 | Ritrovato et al. | 16/430 |
| 7,108,616 | B2 | 9/2006 | Morrow et al. | |
| 7,201,678 | B2 | 4/2007 | Filice et al. | |
| 7,371,196 | B2 | 5/2008 | Morrow et al. | |
| 2002/0094891 | A1 * | 7/2002 | Horwood et al. | 473/560 |
| 2005/0137037 | A1 * | 6/2005 | Tucker, Sr. | 473/513 |
| 2005/0197219 | A1 * | 9/2005 | Casasanta, Jr. | 473/560 |
| 2006/0198978 | A1 * | 9/2006 | Antonini | 428/41.8 |
| 2007/0193431 | A1 * | 8/2007 | Sweeney | 84/327 |
| 2008/0153635 | A1 | 6/2008 | Morrow et al. | |
| 2008/0293458 | A1 * | 11/2008 | Foster | 455/575.1 |

OTHER PUBLICATIONS

IGNITE, Lacrosse Handle—Brine (prior art).
IGNITE SUPRA, Lacrosse Handle—Brine (prior art).
TRIAX, Lacrosse Handle—DeBeer (prior art).
CPSC Web Page, Jun. 1997, web page downloaded May 11, 2005, www.cpsc.gov/cpspub/prerel/prhtml97/97142.html, 1 page (prior art).
STX Lacrosse 2003 Equipment Apparel Catalog, 2 pages (prior art).
Brine 2000 Men and Women Catalog, 4 pages (prior art).
Plastidip Data Sheet, 2002, 2 pages.

* cited by examiner

LACROSSE HANDLE WITH GRIPPING STRUCTURE

CROSS REFERENCE TO RELATED APPLICATION

This application claims benefit to U.S. Provisional Application 61/055,488 filed May 23, 2008, which is hereby incorporated by reference.

TECHNICAL FIELD

The present invention relates generally to a handle, and more particularly to a handle having a raised gripping structure for improved handling and tactile feedback.

BACKGROUND OF THE INVENTION

Lacrosse handles constructed from hollow metal tubes were developed to replace prior wooden lacrosse handles, which were susceptible to damage from exposure to water, and were relatively heavy and cumbersome. Typically, metal tube lacrosse handles are constructed from aluminum, titanium, or other suitable strong, lightweight alloys. Such lacrosse handles have a durable construction and enhance a player's ability to manipulate and carry the handles.

The outer surface of many conventional lacrosse handles are smooth. Typically, the smooth outer surface can be bare, or can include a coating that does not affect the overall smooth surface characteristics of the handle. The smooth outer surface of the handle can enable a player to easily move their hands up and down the handle to control the lacrosse stick during play.

However, a smooth outer surface is not always desirable for a lacrosse player. For instance, it is sometimes desirable for the lacrosse stick to remain properly positioned during play, especially when the stick is contacted by others. The smooth outer surface provides little hand positioning assistance. This can be an issue on the lower portion of the handle near the end cap as a player's lower hand typically grips the handle in a single position, that is, a location relative to the top and bottom of the handle, for most of the time while engaged in a lacrosse activity.

Further, a smooth outer handle surface does not enable a player to identify the relative location of his or her hand during play. For example, other than by visual recognition or tactile confirmation via the end cap, a lacrosse player usually finds it difficult to determine the relative location of their lower hand on the handle of the stick. This may effect a player's ability to pass, shoot, or otherwise control a lacrosse ball during play.

In response to these concerns, many lacrosse players wrap tape on portions of the lacrosse handle before engaging in a lacrosse activity. These features add weight to the lacrosse handle, and may effect the overall balance of the lacrosse stick—both of which are undesirable features in terms of performance and consistency. Further, the tape usually wears out quickly, and must be replaced, which is a time consuming process.

SUMMARY OF THE INVENTION

A lacrosse handle is provided that includes a gripping structure along portions of the lacrosse handle that enhances a player's grip on the handle.

In one embodiment, the raised gripping structure is included near a lower end, for example, the end of the lacrosse handle that is distal from a point of attachment for a lacrosse head of the handle. The raised gripping structure can enable the player to better grip the handle to maintain the position of the lower hand during a lacrosse activity.

In another embodiment, the gripping structure may have a certain pattern along portions of the handle. Optionally, the pattern of the gripping structure can vary along the lower end of the handle to provide tactile feedback regarding the precise positioning of the lower hand at a particular location between the top end and bottom end of the handle.

In yet another embodiment, an upper portion of the lacrosse handle can remain substantially bare, that is, without a gripping structure. This can enable the top hand to be easily positioned and repositioned by sliding the hand up and down the upper portion of the handle during play. In this way, optimized control of the lacrosse stick by a player may be realized.

In still another embodiment, the raised gripping structure can be constructed from a polymeric material, optionally a clear lacquer material, that is, joined with an ink layer to provide desired aesthetics. The ink layer and lacquer material may be printed or joined with a paper substrate material to form a decal. The polymeric material and ink layers of the decal can be joined with the lacrosse handle via a water transfer process.

In another further embodiment, the gripping structure can have a desired thickness, which can vary along a length of the handle. Optionally, the thickness of the gripping structure can decrease from the lower end toward the upper end of the handle.

A lacrosse handle including the gripping structures described herein is easily, selectively gripped and maneuvered. For example, a player can slide their top or upper hand to a variety of positions while allowing the bottom or lower hand to have improved grip on the handle as compared with conventional smooth surfaced lacrosse handles. Where the lacrosse handle includes a raised surface structure along a portion of the handle near the butt end of the handle, the handle can provide tactile recognition points to a lacrosse player for properly and consistently orienting their hand during play to provide enhanced performance.

These and other objects, advantages, and features of the invention will be more fully understood and appreciated by reference to the description of the current embodiment and the drawings.

DETAILED DESCRIPTION OF THE CURRENT EMBODIMENT

Figure 1:
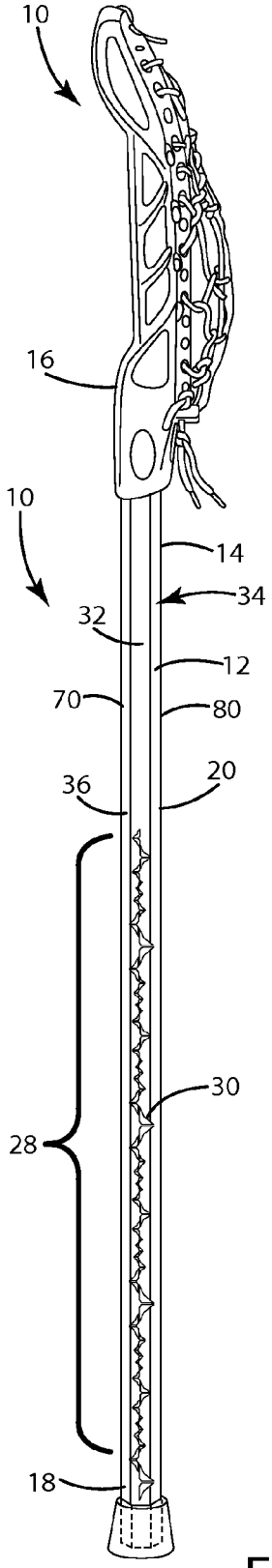
FIG. 1 is a side view of a handle of the current embodiment including an attached lacrosse head.

The handle of a current embodiment is suited to be joined with a lacrosse head. In this regard, the current embodiment employs features where the context permits, for example, a lacrosse handle having a top end for attachment of a lacrosse head and a bottom end including a raised gripping structure. However, the handle can be used with other devices as desired. Accordingly, a variety of other embodiments are contemplated, each having different combinations of the described features, each having features other than those described herein, or even lacking one or more of those features. It is therefore understood that the invention can be carried out in various other suitable modes. For example, the disclosed handle can be used for ice hockey, field hockey, roller hockey or the like.

A current embodiment of the handle is illustrated in FIGS. 1-7 and generally designated 12. The handle 12 can include a tubular member 20 having a top or upper end 14 for attachment to a lacrosse head 16 and a bottom or lower end 18 that is opposite to the upper end 14. The handle 12 can be a tubular member 20 in the form of an extruded hollow metal tube. The tubular member 20 can be constructed of an aluminum, titanium or other metal material. Alternatively, the tubular member can be constructed from various other suitable materials, such as composites or plastics, and can be produced by a variety of other suitable manufacturing processes. Moreover, the tubular member 20 can take on a variety of different cross sections, shapes and lengths, and indeed can be non-tubular. For example, the member 20 can be generally solid.

The tubular member 20 optionally includes an outer surface 22 that may include one or more predetermined portions having a coating (not shown) applied thereto. Optionally, the coating can strengthen the tubular member 20 so as to minimize scratches, dents, dings, and/or other damage thereto. In addition, the coating can maintain a substantially lightweight construction of the handle 12. Moreover, the coating can provide decorative or aesthetic features on portions of the tubular member 20. The coating can be smooth and can include an exterior surface that lies in a plane parallel to, and optionally above, the outer surface 22 of the handle 12. Optionally, the coating can be constructed from a variety of materials, such as rubber, elastomers, polymers, powdercoat, or any other suitable material. Further optionally, the coating can be opaque, transparent, or translucent as desired.

Figure 2:
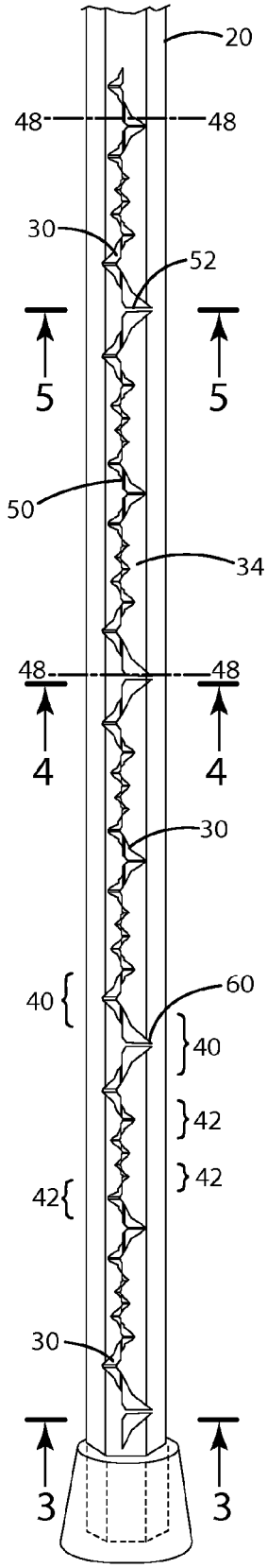
FIG. 2 is an enlarged left side view of a portion of the lacrosse handle.

With reference to FIG. 2, the tubular member can define a length extending from the upper end to the lower end, and a girth, that is, a distance around the entire tubular member. For example, if the tubular member is cylindrical, the girth can correspond to the circumference of the cylinder. At least a portion 28 of the outer surface 22 at or near the lower end 18 of the handle 12 can include one or more raised gripping structures 30. Each gripping structure 30 can include a material applied to a portion of the handle outer surface 22 and/or the coating, if included.

Figure 3:
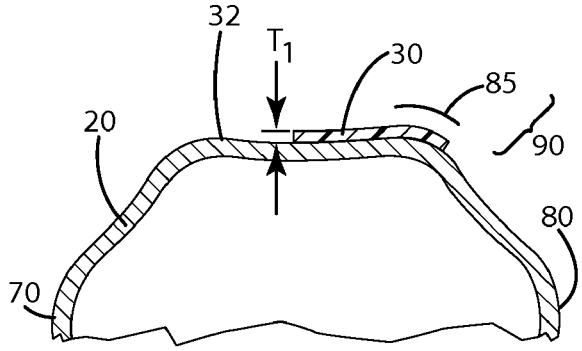
FIG. 3 is a cross-section view of the lacrosse handle taken along line 3-3 of FIG. 2.
Figure 4:
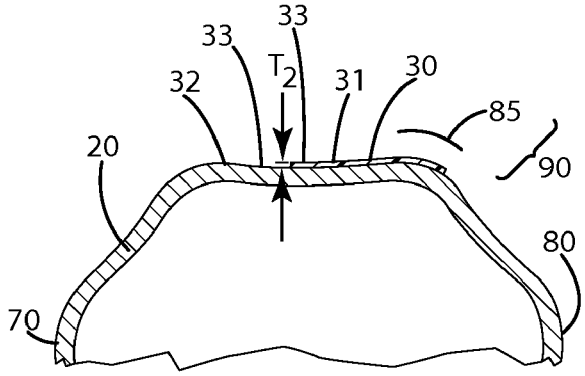
FIG. 4 is a cross-section view of the lacrosse handle taken along line 4-4 of FIG. 2.
Figure 5:
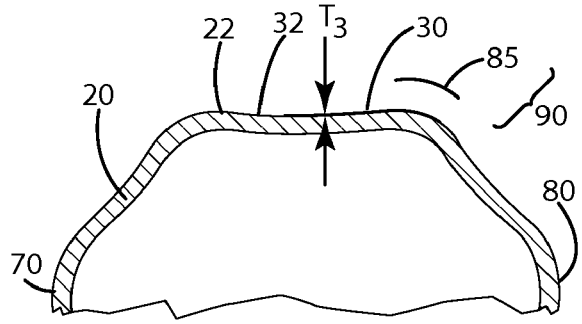
FIG. 5 is a cross-section view of the lacrosse handle taken along line 5-5 of FIG. 2.

As shown in FIGS. 3-5, the thickness $T_1$, $T_2$, $T_3$ of the gripping structure 30 can be sufficient so that it may be felt, or sensed via touch, by a user gripping the handle 12. The thicknesses $T_1$, $T_2$, $T_3$ can be sufficiently thick to prevent a user's hand from easily sliding up and down, or twisting around, the handle 12 in the area including the gripping structure 30. At the same time, the thickness $T_1$, $T_2$, $T_3$ can be thin enough so that the user can still engage the handle 12 with their hand in regions adjacent the gripping structure 30. Further, the thickness $T_1$, $T_2$, $T_3$ can be of the same thickness, or can vary as desired, with the thickness generally decreasing from the lower end 18 to the upper end 14, or vice versa.

As shown in FIGS. 3-5, the gripping structure 30 can be applied along the sides 32, 34 of the handle 12 beginning at the lower end 18 and extending toward the middle portion 36 of the handle 12, approximately half way between the upper end 14 and lower end 18. The gripping structure 30 can be located in the lower end 18, and can extend slightly past the middle portion 36 of the handle, terminating short of the upper end 14 of the handle, so that at least a portion of the upper end of the handle remains uncovered by the gripping structure to enable a player to grip the smooth outer surface of the handle near the upper end. However, if desired, the gripping structure 30 can extend into the upper end 14, and cover the entire length of the handle.

Optionally, the gripping structure can extend along varying combinations of the upper, lower and middle portions of the handle. Further, the gripping structure 30 can be configured so that it extends only around a portion of the girth of the tubular member 20, for example, a single gripping structure 30 might extend across only two or three sides of and octagon-shaped member 20, or only through about 30 degrees, optionally about 60 degrees, further optionally about 90 degrees, and even further optionally about 120 degrees of the handle when the handle is viewed in cross section. Of course, if desired, the gripping structure could extend around the entire girth.

Figure 6:
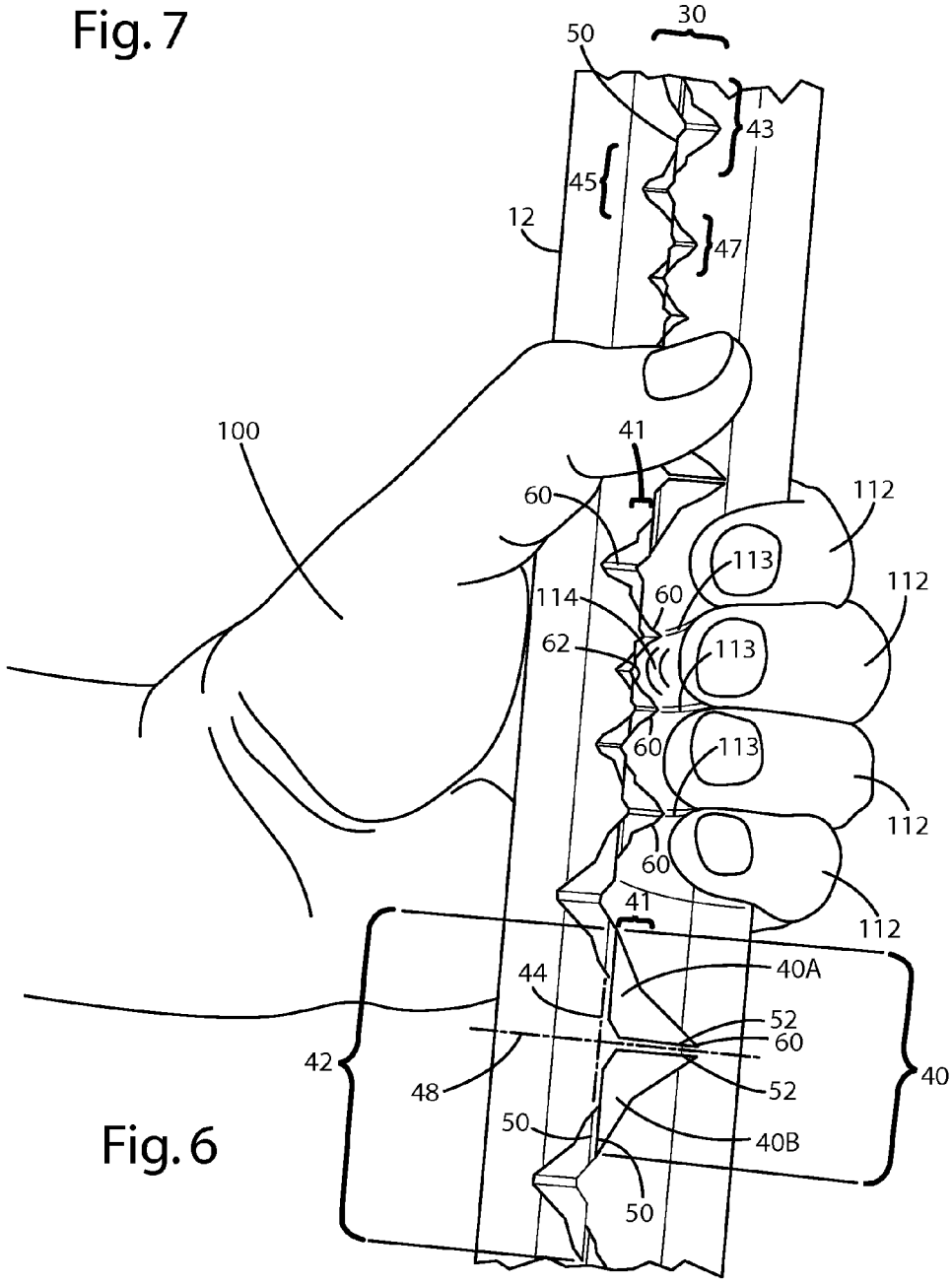
FIG. 6 is a view of the lacrosse handle being gripped by a hand of a player.

With reference to FIGS. 2 and 6, the gripping structure 30 can include a pattern of gripping units 40, wherein each one of the alternating pair 42 of the gripping units 40 can be of an arrow shape having its apex or point 60 laying on opposite sides of a longitudinal reference axis 44 that extends along the length of the handle 12 between the lower end 18 toward the middle portion 36 as illustrated. Of course, the gripping units can be of other shapes, such as square, trapezoidal, or curved. The gripping units 40 can also include a base 41 that transitions to the point 60, with the base laying generally adjacent the longitudinal reference axis 44.

Each individual gripping unit 40 of the alternating pair 42 of gripping structure 30 also can be subdivided by a lateral reference axis 48 that extends transversely, for example, perpendicular to the longitudinal reference axis 44 and form adjacent gripping unit elements or sub-parts 40*a*, 40*b*, which can be mirror images of one another, in terms of size and shape, and located on opposite sides of the lateral reference axis. The size of each one of the adjacent alternating pairs 42 of the gripping structure 30 can be varied randomly, or in a non-random pattern, relative to the next adjacent alternating pair.

As shown in FIG. 6, a first gripping unit 43 can be generally larger in size than a second gripping unit 45 on the opposite side of the longitudinal reference axis 44. Where the gripping units include points, the points of gripping units on opposite sides of the longitudinal reference axis 44 can point in opposite directions, away from the longitudinal reference axis 44. Further, both the first and second gripping units 43 and 45 can be larger than a third gripping unit 47 on the same side of the longitudinal reference axis 44 as the first gripping unit 43. Optionally, the sizes of the gripping units can be uniform, or mixed and matched as desired. Further optionally, select ones of the gripping units can be larger than other gripping units in different portions along the handle so that, when felt or perceived by a player's hand (whether through a glove or not), the gripping units can indicate to a user where the hand is located on the handle.

As shown in FIG. 6, each unit 40 of the gripping structure 30 also can include a lower flat portion 50 that extends along the longitudinal reference axis 44, with the lower flat portion 50 of one unit 40 being aligned with a lower flat portion 50 from a gripping unit 40 on an opposite side of the longitudinal reference axis 44. The gripping structure 30 also can include a side flat portion 52 that extends along the length of the lateral reference axis 48 and corresponds to a side flat portion 52 of the adjacent gripping structure 30.

The gripping structure 30 can be formed of durable, wear resistant polymeric material, or other materials as described above, that strongly adheres to or otherwise bonds or joins with the coated or uncoated tubular member 20. An optional polymeric material that can be used is a clear lacquer 31, which can be applied to a thickness of about 0.1 millimeters, 0.2 millimeters, 0.5 millimeters, 1.0 millimeters, 2.0 millimeters, 3.0 millimeters, or other thicknesses as desired. In addition, the gripping structure 30 may also include one or more ink layers 33, in addition to the clear lacquer layers 31. The ink layer 33 can provide a contrasting look to the raised gripping area 30.

The gripping structure 30 can also include thicknesses $T_1$, $T_2$ and $T_3$. Optionally, the maximum thickness can be about 0.5 millimeters, but can vary from about 0.1 millimeters to about 3 millimeters as desired. The thicknesses $T_1$, $T_2$, $T_3$ can be sufficient to allow a hand to be easily placed onto the handle 12, but not easily slid in a direction up the handle 12 (away from the lower end 18) or down the handle 12 (towards the lower end 18). In other words, the gripping structures 30 can be thick enough to impede movement of the hand upward or downward along the handle during play.

As best shown in viewing FIG. 3-5 collectively, the thicknesses $T_1$, $T_2$, $T_3$ of the gripping structures can decrease from the lower end 18 toward the middle portion 36. Optionally, as explained above, gripping portions 30 can be absent in the region between the middle portion 36 and the upper end 14, so that the outer surface of the handle is bare.

By alternating the direction of the points 60 of gripping units on alternating sides of the longitudinal reference axis 44, areas that are covered and uncovered by the gripping structure 30 are created, which can function to enhance the grippability of the handle 12.

An example of the grip enhancement achieved with the gripping structure 30 is illustrated in FIG. 6. There, the handle 12 is generally gripped by a user's hand 100, which may or may not be gloved. As illustrated for simplicity, the gripping structure is shown in solid lines even though it is located between the handle 12 and the user's hand 100. Specifically, in the view illustrated in FIG. 6, it appears that the gripping structure 30 is on the side of the handle 12 facing the viewer of FIG. 6; however, the gripping structure 30 is actually on the opposite side of the handle 12 and would be hidden from view of the handle.

Returning to the grip enhancement provided by the gripping structure 30, as illustrated, a user's hand typically wraps around a portion of the handle with the digits 112 and/or palm overlapping certain portions of the gripping structure 30. Optionally, the digits 112 can be aligned with the gripping structure 30 so that one or more of the points 60 of individual gripping units 40 are aligned with the spaces 113 between the user's digits 112. A portion 114 of the user's digits 112, or other portion of their hand 100, is pressed or forced into a valley or recess 62 located between points 60 of adjacent gripping units 40. By forcing the portion of the user's digits, or a glove (not shown) over the user's digits and/or palm, into the generally v-shaped valley 62, the portion 114 of the user's hand 100 is frictionally wedged within the valley between adjacent gripping structures to provide an enhanced grip on the handle. Of course, where the user's digits and hands do not precisely overlap in the manner illustrated in FIG. 6, the raised gripping structure 30 still yields an enhanced grip when the handle 12 is grasped by the user's hand 100.

While FIG. 6 illustrates the gripping structure 30 generally aligned with the lower portion of a user's digits 112 and/or palm, a user may grasp the handle 12 with their hand 100 so that the user's fingertips overlap and are generally in contact with or immediately adjacent the gripping structure 30. With such a grip, the user can wedge their fingertips or upper extremities of their digits 112 into the respective valleys 62 of the gripping structure.

As noted above, the size of each adjacent alternating pair 42 of gripping structures 30 can be alternated, which can vary the tactile feel of the handle 12 along different portions of the handle 12 from the lower end 18 to the middle portion 36. With this alternating size, a user can determine the relative location of his or her lower hand on the handle 12 by feel, which can provide better control of the lacrosse stick during play.

With reference to FIGS. 2-5, by eliminating the gripping structures 30 on the upper end 14, and decreasing the thickness of the gripping structures 30 from the lower end 18 toward the middle region 36, a user's top hand can be free to move up and down the handle 12 from the upper end 14 to the middle end 36. Thus, the placement and replacement of the upper hand can be generally unrestricted, restricted or otherwise compromised by the gripping structures 30, which allows the user to shoot, pass, or otherwise control the stick as desired.

While FIGS. 1-5 illustrate the gripping structures 30 as having a particular size, shape, and orientation on the tubular member 20, the shape and size of each gripping structure 30 can vary infinitely.

Moreover, the location of gripping structures 30 along the tubular member 20 may vary. For example, additional gripping structures 30 may be added along the top surface 70 or bottom surface 80 of the tubular member 20. In addition, gripping structures 30 may be added to alternative portions of the tubular member 20, including along portions of the tubular member 20 near the upper end 14. In addition, the thickness of any of the gripping structures 30 along any portion of the tubular member 20 may vary in a random or non-random manner.

Optionally, the gripping structures 30 can be formed as decals 90 and applied to the outer surface 22 of the handle 12 at the desired locations using a wet transfer process, adhesives, or any other suitable process. Such pre-formed decals 90 can be added to the handle 12 in any shape or size, and to any area of the tubular member 20 as desired. Alternatively, the gripping structures can be directly molded or machined onto the handle as desired.

Figure 7:
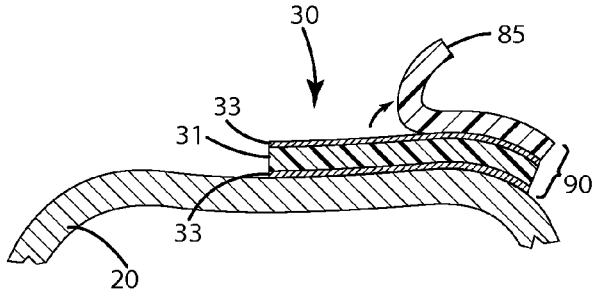
FIG. 7 is a cross-section showing optional layers of a gripping structure.

An example of one optional process to form a gripping structure 30 will now be described with reference to FIG. 7, which shows a gripping structure 30 of exaggerated thickness for illustrative purposes. One or more ink layers 33 can be introduced onto a paper substrate 85 using a graphics printer. One or more clear lacquer layers 31 can be applied over the ink layers 33 to build the gripping structure 30 to its desired thickness, optionally using the same graphics printer. The clear lacquer layer 31 can form the substantial bulk of the overall thickness of the gripping structure 30 as illustrated. Optionally, one or more additional ink layers 33 can be introduced onto the clear layer 31 to give the gripping structure 30 its desired aesthetic appearance. Collectively, the ink layers 33, the lacquer layers 31 and the paper substrate 85 can form a decal 90.

The graphics printer used in the above optional process can include an application device having a spray applicator that applies the ink layers 33 and/or clear lacquer layers 31 separately to the paper substrate 85 to a pre-programmed thickness in one or more separate passes. The thickness and number of layers of ink and lacquer each can be separately controlled via a computer program that is preprogrammed within the graphics printer. The graphics printer can be capable of forming a single gripping structure 30 on the paper substrate 85, or multiple gripping structures (having varying thicknesses) on a single paper substrate 85.

The decal 90 can be removed from the graphics printer and applied via a wet transfer process to transfer clear lacquer layers 31 and ink layers 33 from the paper substrate 85 to the outer surface 22 of the tubular member 20. The paper substrate 85 can be pulled away from the other layers as illustrated in FIG. 7, and then discarded.

The current embodiment can provide several benefits. For example, when used, the optional technique for introducing the gripping structures 30 from decals 90 via a wet transfer process can add raised areas to the tubular member 20. Thus, a manufacturer can vary the feel of the texture, as determined by the thickness by how much or little of the clear lacquer 31 is used, in a particular area of the tubular member 20. As a result, the "feel" of the tubular member 20 to a user can be varied in a virtually limitless number of ways. As another example, because the texture of the gripping structure 30 is raised, it can be felt either by a user's hand, or through lacrosse gloves when used, which potentially reduces the need to add tape to the tubular member 20 for added grip. Tape adds weight and affects the overall balance and playability characteristics of the handle 12 during play.

Finally, if utilized, the use of decals 90 introduced to the outer surface 22 of the tubular member via the optional wet transfer process is a simple, repeatable process that allows multiple gripping structures 30 to be precisely formed on a single paper substrate 85 in a desired configuration and applied to the handle in a single step. In addition, when used, multiple gripping structures 30 having various shapes, sizes, and thicknesses may be applied to the outer surface 22 in a single step, which is highly efficient and cost effective.

The above description is that of the current embodiment of the invention. Various alterations and changes can be made without departing from the spirit and broader aspects of the invention as defined in the appended claims, which are to be interpreted in accordance with the principles of patent law including the doctrine of equivalents. Any reference to claim elements in the singular, for example, using the articles "a," "an," "the" or "said," is not to be construed as limiting the element to the singular.

The invention claimed is:

1. A handle for a lacrosse stick, comprising:

a tubular member including an upper end adapted to attach to a lacrosse head, a lower end distal from and opposite the upper end, and a middle region between the upper end and the lower end, the tubular member including an outer surface; and a gripping structure joined with the outer surface, wherein the gripping structure extends from the lower end toward the middle region, but terminates short of the upper end so that at least a portion of the upper end remains uncovered by the gripping structure enabling a player to grip the outer surface adjacent the upper end, wherein the gripping structure includes a first plurality of arrow-shaped gripping units including a plurality of first points, and a second plurality of arrow-shaped gripping units including a plurality of second points extending from a plurality of bases respectively, the first and second plurality of gripping units positioned on opposite sides of a longitudinal reference axis so that the first points and second points point in opposite directions away from the longitudinal reference axis, wherein each of the plurality of first points are separated from one another, wherein adjacent ones of the plurality of first points, at least one of the bases, and the outer surface of the tubular member cooperatively define a recess, wherein the recess is void of gripping units such that the recess is adapted to receive at least one of a user's digit, the user's hand and a glove on the user's hand and enhance the user's grip on the handle, wherein the gripping structure includes a thickness that varies from the lower end toward the upper end, the thickness increasing toward the lower end and wherein the gripping structure is raised relative to the outer surface of the tubular member so that the recess forms a recessed pocket.

2. The handle of claim 1 wherein the thickness is at least 0.2 millimeters, and wherein the recess is of a depth equal to the thickness, the depth extending from the outer surface of the tubular member to an upper surface of the gripping units adjacent the recess.

3. The handle of claim 1 wherein the gripping structure is joined with the lower end and the middle region.

4. The handle of claim 1 wherein the first plurality of arrow-shaped gripping units includes a first arrow-shaped gripping unit and a second arrow-shaped gripping unit, wherein the first arrow-shaped gripping unit is of an identical shape to, but larger in size than, the second arrow-shaped gripping unit.

5. The handle of claim 1 wherein at least one of size and shape of each of the first plurality of arrow-shaped gripping units varies in a non-random pattern.

6. The handle of claim 1 wherein at least one of size and shape of each of the first plurality of arrow-shaped gripping units varies randomly.

7. The handle of claim 1 wherein at least one of the first plurality of arrow-shaped gripping units includes adjacent gripping unit elements located on opposite sides of a lateral reference axis, wherein the lateral reference axis is perpendicular to the longitudinal reference axis.

8. The handle of claim 1 wherein the gripping structure includes a plurality of layers of a clear lacquer material joined with an ink layer, the ink layer being visible through the clear lacquer material to provide the gripping structure with color contrast relative to the outer surface of the tubular member.

9. The handle of claim 1 wherein the recess is triangular.

10. A handle for a lacrosse stick, comprising:

a member including an upper end adapted to attach to a lacrosse head, a lower end distal from and opposite the upper end, and a middle region between the upper end and the lower end, the member including an outer surface, the member defining a length and a girth; and a gripping structure joined with the outer surface, the gripping structure including a longitudinal reference axis aligned with the length, wherein the gripping structure includes a plurality of first gripping units and a plurality of second gripping units, the plurality of first gripping units including a plurality of first bases and a plurality of first points, the plurality of second gripping units including a plurality of second bases and a plurality of second points, wherein the first and second bases are substantially collinear with the longitudinal reference axis, the first points pointing outward in a first direction, away from the longitudinal reference axis, the second points pointing outward in a second direction substantially opposite the first direction, away from the longitudinal reference axis, wherein the gripping structure extends only partially around the girth of the member, wherein the gripping structure includes a thickness that decreases from the lower end toward the upper end and wherein the gripping structure is raised relative to the outer surface of the tubular member so that the recess forms a recessed pocket.

11. The lacrosse handle of claim 10 wherein each of the plurality of points are separated from one another so that adjacent ones of the points and the outer surface of the member cooperatively define a valley, wherein the valley is void of gripping units and is adapted to receive at least a portion of at least one of a user's digit, the user's hand and a glove on the user's hand, and enhance the user's grip on the handle.

12. The handle of claim 11 wherein the gripping structure is raised relative to the outer surface of the member so that a recess is bounded by the valley and the outer surface of the member, the recess adapted to receive at least one of the user's digit, the user's hand and a glove on the user's hand.

13. The handle of claim 10 wherein each gripping unit is generally arrow shaped, with the arrow pointing away from the longitudinal reference axis.

14. The handle of claim 10 wherein the plurality of gripping units include a first arrow-shaped gripping unit on a first side of the longitudinal reference axis and a second arrow-shaped gripping unit on a second, opposite side of the longitudinal reference axis, the first and second arrow-shaped gripping units pointing in opposite directions.

15. The handle of claim 14 wherein the first arrow-shaped gripping unit and the second arrow-shaped gripping unit are of identical shape, but the first arrow-shaped gripping unit is larger in size than the second arrow-shaped gripping unit.

16. The handle of claim 10 wherein the gripping structure includes a clear lacquer material and an ink layer that provide at least a portion of the thickness and provide the gripping structure with color contrast relative to the outer surface of the member.

17. The handle of claim 10, wherein each gripping unit includes a first sub-part and a second sub-part that are mirror images of one another, but separated by a lateral reference axis that is generally perpendicular to the longitudinal reference axis.

18. The handle of claim 17 wherein the plurality of first bases and plurality of first points are substantially positioned on one side of the longitudinal axis and the plurality of second bases and plurality of second points are substantially positioned on a second, opposite side of the longitudinal axis, wherein the first sub-part and second sub-part each include a side flat portion that extends along the lateral reference axis.

19. A handle for a lacrosse stick, comprising:

a member including an upper end adapted to attach to a lacrosse head, a lower end distal from and opposite the upper end, and a middle region between the upper end and the lower end, the member including an outer surface and defining a length; and a gripping structure joined with the outer surface, the gripping structure including a longitudinal reference axis aligned with the length, wherein the gripping structure extends from the lower end toward the middle region, wherein the gripping structure includes a plurality of gripping units separated from one another so that adjacent ones of the plurality of gripping units cooperate with said outer surface of the member to define a recess bounded by said outer surface and said adjacent ones of the plurality of gripping units, wherein the adjacent ones of the plurality of gripping units and the respective recess are adapted to engage at least one of a user's digit, a user's hand and a glove on the user's hand and enhance the user's grip on the handle, wherein the plurality of gripping units includes a first gripping unit including a first point and a first base, and a second gripping unit including a second point and a second base, the first and second gripping units positioned substantially on opposite sides of the longitudinal reference axis so that the first base and second base are substantially aligned along, and at least one of immediately adjacent and overlapping, the longitudinal reference axis, and so that the first point and second point point substantially in opposite directions, away from the longitudinal reference axis and wherein the gripping structure is raised relative to the outer surface of the tubular member so that the recess forms a recessed pocket.

20. The handle of claim 19 the plurality of gripping units define a first plurality of recesses and a second plurality of recesses, each recess bounded by adjacent ones of the plurality of gripping units and the outer surface of the member, wherein each recess is substantially triangular-shaped, wherein each of the first plurality of recesses open in a first direction substantially away from the longitudinal reference axis and each of the second plurality of recesses open in a second direction substantially away from the longitudinal reference axis, wherein the second direction is substantially opposite the first direction.

21. The handle of claim 19 wherein the gripping structure includes a thickness that decreases from the lower end toward the upper end, wherein the user can perceive the increasing thickness and determine the location of the at least one of the user's hand and the glove on the user's hand relative to the upper end and lower end of the member.

22. A method for improving grip and tactile feedback on a lacrosse handle comprising:

forming a tubular member having an upper end adapted to attach to a lacrosse head, a lower end distal from and opposite the upper end, and a middle region between the upper end and the lower end, the tubular member including an outer surface and defining a length;

forming a gripping structure to include a plurality of first and second gripping units, each gripping unit including a base and a point, said forming a gripping structure including substantially aligning the bases of the first and second gripping units along a longitudinal reference axis, pointing the points of the first gripping units in a first direction substantially away from the longitudinal reference axis and pointing the points of the second gripping units in a second direction opposite the first direction, away from the longitudinal reference axis and wherein the gripping structure is raised relative to the outer surface of the tubular member so that the recess forms a recessed pocket;

joining the gripping structure with a predetermined portion of the outer surface at a thickness sufficient to provide tactile feedback to a user so that the user can determine the location of at least one of the user's hand and a glove on the user's hand relative to the upper end and lower end of the tubular member; and forming a recess bounded by the outer surface of the tubular member, first and second points of adjacent first gripping units, and a base of a second gripping unit adjacent the adjacent first gripping units.

23. The method of claim 22 wherein forming a gripping structure includes:

providing a paper substrate;

joining an ink layer to the paper substrate to provide color contrast between the gripping structure and the outer surface of the tubular member;

joining a clear lacquer material with the ink layer to attain a thickness of the clear lacquer material, and optionally joining an additional ink layer to the clear lacquer material;

wherein the paper substrate, the ink layer, and the optional additional ink layer collectively define a decal.

* * * * *